US009097171B2

(12) United States Patent
Brinkmann et al.

(10) Patent No.: US 9,097,171 B2
(45) Date of Patent: Aug. 4, 2015

(54) LIQUID-COOLED INTERNAL COMBUSTION ENGINE HAVING EXHAUST-GAS TURBOCHARGER

(75) Inventors: Bernd Brinkmann, Dormagen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 449 days.

(21) Appl. No.: 13/572,286

(22) Filed: Aug. 10, 2012

(65) Prior Publication Data

US 2013/0036734 A1 Feb. 14, 2013

(30) Foreign Application Priority Data

Aug. 10, 2011 (EP) ..... 11177050

(51) Int. Cl.

| | |
|---|---|
| ***F02B 33/44*** | (2006.01) |
| ***F01P 1/06*** | (2006.01) |
| ***F01P 7/14*** | (2006.01) |
| ***F04B 17/00*** | (2006.01) |
| ***F01P 3/12*** | (2006.01) |
| *F01P 11/02* | (2006.01) |

(52) U.S. Cl.

CPC ..... *F01P 3/12* (2013.01); *F01P 11/029* (2013.01); *F01P 2031/30* (2013.01); *F01P 2060/12* (2013.01)

(58) Field of Classification Search

CPC ..... F01P 3/12; F01P 2060/12; F01P 2031/30; F01P 11/029

USPC ..... 60/605.3; 123/41.31, 41.08; 417/407

See application file for complete search history.

(56) References Cited

U.S. PATENT DOCUMENTS

| | | | | | |
|---|---|---|---|---|---|
| 3,827,236 | A | * | 8/1974 | Rust | 60/605.3 |
| 4,107,927 | A | * | 8/1978 | Gordon et al. | 417/407 |
| RE30,333 | E | * | 7/1980 | Gordon et al. | 417/407 |
| 4,561,387 | A | | 12/1985 | Körkemeier et al. | 123/41.31 |
| 4,608,827 | A | * | 9/1986 | Hasegawa et al. | 123/41.31 |
| 4,739,619 | A | * | 4/1988 | Koerkemeier | 60/605.3 |
| 4,829,939 | A | * | 5/1989 | Veenemans et al. | 60/605.3 |
| 4,928,637 | A | * | 5/1990 | Naitoh et al. | 60/605.3 |
| 4,958,600 | A | | 9/1990 | Janthur | 60/605.3 |
| 7,912,620 | B2 | * | 3/2011 | French et al. | 701/102 |
| 2012/0006286 | A1 | * | 1/2012 | Brinkmann et al. | 123/41.08 |

(Continued)

FOREIGN PATENT DOCUMENTS

| | | | | | |
|---|---|---|---|---|---|
| DE | 102008011257 | A1 | | 9/2009 | |
| DE | 102008042660 | A1 | * | 4/2010 | F01P 3/12 |
| EP | 0271136 | A1 | | 11/1987 | |

(Continued)

*Primary Examiner* — Thai Ba Trieu

(74) *Attorney, Agent, or Firm* — Julia Voutyras; Alleman Hall McCoy Russell & Tuttle LLP

(57) ABSTRACT

A thermosiphon system in an engine is provided herein. The thermosiphon system includes a coolant channel traversing a bearing housing, the bearing housing included in a bearing coupled to a shaft mechanically coupled to a turbine and a compressor in a turbocharger, a ventilation vessel in fluidic communication with at least one coolant passage traversing at least one of a cylinder head and a cylinder block in the engine, the at least one coolant passage included in a cooling circuit, and a thermosiphon coolant line having an inlet in fluidic communication with an outlet of the coolant channel and an inlet of the ventilation vessel, the inlet positioned vertically below an interface between liquid and vapor coolant in the ventilation vessel.

19 Claims, 2 Drawing Sheets

(56) References Cited

U.S. PATENT DOCUMENTS

| | | | | |
|---|---|---|---|---|
| 2012/0174579 | A1* | 7/2012 | Brinkmann | 60/605.3 |
| 2013/0047940 | A1* | 2/2013 | Quix et al. | 123/41.08 |
| 2013/0315712 | A1* | 11/2013 | Bogner et al. | 415/116 |
| 2013/0323020 | A1* | 12/2013 | Bogner et al. | 415/116 |
| 2013/0323022 | A1* | 12/2013 | Bogner et al. | 415/116 |
| 2013/0333643 | A1* | 12/2013 | Kaulen et al. | 123/41.08 |
| 2014/0287331 | A1* | 9/2014 | Mayr et al. | 429/410 |

FOREIGN PATENT DOCUMENTS

| | | | | | |
|---|---|---|---|---|---|
| EP | 1384857 | A2 | | 1/2004 | |
| JP | 60222526 | A | * | 11/1985 | F02B 39/00 |
| JP | 2005009434 | A | * | 1/2005 | F02B 39/14 |
| WO | WO 2012107483 | A1 | * | 8/2012 | F02B 39/00 |

* cited by examiner

LIQUID-COOLED INTERNAL COMBUSTION ENGINE HAVING EXHAUST-GAS TURBOCHARGER

CROSS-REFERENCE TO RELATED APPLICATIONS

This application claims priority to European Patent Application Number 11177050.9 filed on Aug. 10, 2011, the entire contents of which are hereby incorporated herein by reference for all purposes.

BACKGROUND/SUMMARY

Internal combustion engines may include at least one cylinder head connected to an engine block to form one or more cylinders. To hold the pistons and/or cylinder liners, the cylinder block which may form a crankcase, has cylinders bores which correspond to the number of cylinders in the engine. The pistons may be guided in the cylinder liners in an axially movable fashion and, together with the cylinder liners and the cylinder head, form the combustion chambers of the internal combustion engine.

Internal combustion engines may be boosted to increase the power output of the engine. Providing boost to engines involves compression intake air delivered to the combustion chambers. Devices used to provide boost include turbochargers and superchargers. Superchargers may include compressors which are mechanically driven via the transmission while turbochargers may use exhaust gas to drive a turbine which in turn is rotationally coupled to a compressor. Specifically, in a turbocharger the compressor and turbine may be arranged on the same shaft. Hot exhaust-gas flow may be supplied to the turbine, expanding in said turbine with a release of energy and setting the shaft, which is mounted in a bearing housing, into rotation. The energy supplied by the exhaust-gas flow to the turbine and ultimately to the shaft is used for driving the compressor, which is likewise arranged on the shaft. The compressor conveys and compresses the charge air supplied thereto. As a result, boosting of the engine is achieved.

One of the benefits of an exhaust-gas turbocharger, for example in relation to a mechanical charger (e.g., supercharger), is that no mechanical connection for transmitting power is needed between the compressor and internal combustion engine. In contrast, mechanical chargers, such as superchargers, extract the energy for driving the compressor from the crankshaft of the internal combustion engine, thereby reducing the power output of the engine and consequently adversely affecting engine efficiency. In contrast, turbochargers utilize the exhaust-gas energy of the hot exhaust gases which are directed to the surrounding environment.

Boosted internal combustion engines may be equipped with a charge-air cooling arrangement configured to cool the compressed combustion air before entering the cylinders. As a result, the density of the supplied charge air is further increased. In this way, the cooling likewise contributes increasing the density of the air delivered to the cylinders. In other words, the volumetric efficiency of the combustion chambers is increased.

Boosting engines, and in particular turbocharging engines, enables the power of the engine to be increased while maintaining an unchanged swept volume, or enables a reduction in swept volume while maintaining the same power output. Therefore, Boosting engines provided an increase in the volumetric power output and/or provide an increased power-to-weight ratio. For the same vehicle boundary conditions, it is thus possible to shift the load collective toward higher loads at which the specific fuel consumption is lower. This is also referred to as downsizing.

However, problems are encountered in the configuration of the exhaust-gas turbocharging, where it is desirable to achieve a performance increase over a wide range of rotational speed ranges. In some engines, a severe torque drop is commonly observed if the rotational speed drops below a certain rotational speed. Further in some engines improvements in torque characteristics of the engine may be desired. To achieve the enhanced torque characteristics attempts have been made to reduce the size of the cross-section of the turbine and simultaneous exhaust-gas blow-off. If the exhaust-gas mass flow exceeds a threshold value, a part of the exhaust-gas flow is conducted, within the course of the exhaust-gas blow-off, via a bypass line past the "waste-gate turbine". However, said approach has some downsides at relatively high rotational speeds.

Other attempts have been made to improve the torque characteristics of the engine via a plurality of turbochargers provided in a series and/or parallel arrangement. However, boosting engines may increase the thermal loading on the engine caused by the increasing the pressure of the intake air when compared naturally aspirated engines. As a result, increased demands are placed on the cooling arrangement in the engine. To keep the thermal loading within limits, boosted internal combustion engines may be equipped with a cooling arrangement, also referred to as an engine cooling arrangement. It is possible for the cooling arrangement to take the form of an air-cooling arrangement or a liquid-cooling arrangement. Since significantly greater amounts of heat may be dissipated by means of a liquid-cooling arrangement, a liquid-cooling arrangement may be used in many engines.

In some liquid-cooling arrangements, a cylinder block coolant jacket and a cylinder head coolant jacket may be provided. The coolant jackets may include coolant passages traversing the cylinder block and/or cylinder head. Adding the coolant passages increases the complexity of the structure. Additionally, the coolant passages may decrease the strength of the cylinder head or cylinder block which are mechanically and thermally loaded. Furthermore, in liquid-cooling arrangements heat is dissipated to the coolant, generally water provided with additives, in the interior of the cylinder head or cylinder block. In this case, the coolant is conveyed, such that it circulates, by a pump which may be arranged in the cooling circuit and which may be mechanically driven by a traction mechanism drive. The heat dissipated to the coolant is thereby discharged from the interior of the cylinder head or cylinder block and is extracted from the coolant again in a heat exchanger. A ventilation vessel may be provided in the cooling circuit. The ventilation vessel may ventilate the coolant or the circuit. In other words, vapor may be removed from the coolant in the circuit and flowed to the ventilation vessel.

Like the internal combustion engine itself, turbines in exhaust-gas turbochargers may have increased thermal loadings. Therefore, the turbine housing in some prior art turbochargers may be produced from heat-resistant material which may contain nickel and/or may be equipped with a liquid-cooling arrangement. EP 1 384 857 A2 and German laid-open specification DE 10 2008 011 257 A1 describe liquid-cooled turbines and turbine housings.

The hot exhaust gas of the turbocharged internal combustion engines may also lead to high thermal loading of the bearing housing and consequently on the bearing of the turbocharger shaft. Furthermore, a large amount of heat may be transferred to the oil provided to the bearing for lubrication.

On account of the high rotational speed of the turbocharger shaft, the bearing may be formed as a plain bearing rather than a rolling bearing. As a result, of the relative movement between the shaft and the bearing housing, a hydrodynamic lubricating film, which is capable of supporting loads, forms between the shaft and the bearing bore. Increasing the temperature of the oil decreases the oil's viscosity, thereby degrading the friction characteristics of the oil. Additionally, increasing the temperature of the oil accelerates the oil's aging, thereby degrading the oil's lubrication properties. Both of these phenomena shorten the service interval for oil changes and can pose a risk to the functional capability of the bearing, wherein even irreversible destruction of the bearing and therefore of the turbocharger is possible.

Therefore, the bearing housing of a turbocharger of an internal combustion engine may be equipped with a liquid cooling arrangement. Here, a distinction must be made between the liquid-cooling arrangement of the bearing housing and the abovementioned liquid-cooling arrangement of the turbine housing. Nevertheless, the two liquid-cooling arrangements may be connected to one another, optionally only intermittently, that is to say fluidly communicate with one another.

In contrast to the engine cooling or cooling of the turbine housing, it may be desirable to maintain the cooling of the bearing housing when the vehicle has been shut down, that is to say the internal combustion engine has been switched off, at least for a certain period of time after the internal combustion engine has been switched off, in order to reduce the likelihood irreversible damage to the turbine housing as a result of thermal overloading. This may be achieved by an additional, electrically operated pump which is powered, for example, by the on-board battery, which pump conveys coolant via a connecting coolant line through the bearing housing when the internal combustion engine has been switched off and therefore provides cooling of the bearing housing and of the bearing even when the internal combustion engine is not in operation. The provision of an additional pump is, however, a comparatively costly measure.

Some engines may not include an additional pump. In this case, the connecting coolant line, which leads from the cooling circuit of the engine-cooling arrangement through the bearing housing of the exhaust-gas turbocharger as far as the ventilation vessel, is designed as a rising line, at least upstream of the bearing housing. The conveying of the coolant when the internal combustion engine is switched off may be achieved by what is referred to as the thermosiphon effect, which is essentially based on two mechanisms.

Owing to the introduction of heat, which continues even when the internal combustion engine is switched off, from the heated bearing housing into the coolant situated in the connecting coolant line, the coolant temperature increases, as a result of which the density of the coolant decreases and the volume taken up by the coolant increases. Superheating of the coolant may furthermore lead to a partial evaporation of coolant, and therefore coolant passes into the gaseous phase. In both cases, the coolant expands and takes up a larger volume, as a result of which ultimately further coolant is displaced, that is to say conveyed, in the direction of the ventilation vessel. Coolant is supplied as a result of the negative pressure which arises.

However, the Inventors have recognized several problems with using a thermosiphon to convey coolant to a bearing housing. Due to the constricted space conditions in the engine compartment of a vehicle, it may not be possible to form the connecting coolant line as a rising line upstream of the bearing housing or to realize the difference, which is needed for the thermosiphon effect, in the vertical height between the bearing housing and ventilation vessel. The reasons are as follows. It may be desirable in the use of an exhaust-gas turbocharger to arrange the turbine of the at least one charger adjacent to the outlet of the internal combustion engine, that is to say the outlet openings of the cylinders, in order to be able to use the enthalpy of the hot exhaust gases, the enthalpy being decisively determined by the exhaust-gas pressure and the exhaust-gas temperature, and to ensure a rapid response behavior of the turbocharger. For the reasons mentioned above, the turbine of the exhaust-gas turbocharger may be arranged directly on the cylinder head and therefore in a position which has a comparatively high vertical height, that is to say in the installed position in an internal combustion engine is positioned at a high point with regard to the other components and assemblies.

This installed position of the turbine or of the bearing housing makes it difficult to design the connecting coolant line upstream of the bearing housing as a rising line in which the vertical height continuously increases. This is because the ventilation vessel cannot be arranged at an arbitrary height above the bearing housing. In particular, for safety reasons, that is to say because of the demands imposed on the crash performance of the vehicle, the components and assemblies installed in the engine compartment may be maintained at a predetermined distance from the engine hood. The maintaining of a prescribed safety distance from the engine hood inevitably leads to an only small difference in height between the bearing housing and ventilation vessel, the lack of a difference in height or, in a particular case, even to a negative difference in height, in which the bearing housing is at a greater vertical height than the ventilation vessel.

The packaging constraints previously mentioned make it difficult to use a thermosiphon to cool the bearing housing to a desired level. Specifically, when the ventilation vessel is positioned in an unfavorable position the resistance against the coolant conveyed from the bearing housing is increased. The result is a longer residence period in the bearing housing, wherein the coolant may be greatly superheated and the pressure may rise sharply, even in the connecting coolant line upstream of the bearing housing.

As a result, superheated coolant vapor of relatively high pressure, in particular coolant vapor, may pass via the connecting coolant line into the ventilation vessel. This may firstly lead to thermal overloading, damage or destruction of the vessel, which may be produced from plastic. Secondly, the increased vessel pressure may lead to a pressure control valve arranged on the vessel opening in an uncontrolled manner and releasing vaporous coolant into the surroundings. This may cause an undesirable production of noise, in particular a whistling. The vessel is generally provided with a cover which closes a vessel opening, which serves for the pouring in of coolant, and frequently also accommodates the pressure control valve. The greatly superheated coolant may also act on the cover and/or the cover seal and lead to the cover sticking.

Furthermore, the above-described pressure and temperature conditions may lead to a pulsating conveying of the coolant, in which the coolant is introduced into the ventilation vessel via the connecting coolant line in surges. This results in frothing and enrichment of the coolant with air. These effects act counter to the actual purpose of the ventilation vessel, namely of degassing, that is to say of ventilating, the coolant.

To solve at least some of the aforementioned problems a thermosiphon system in an engine is provided. The thermosiphon system includes a coolant channel traversing a bearing housing, the bearing housing included in a bearing coupled to a shaft mechanically coupled to a turbine and a compressor in a turbocharger, a ventilation vessel in fluidic communication with at least one coolant passage traversing at least one of a cylinder head and a cylinder block in the engine, the at least one coolant passage included in a cooling circuit, and a thermosiphon coolant line having an inlet in fluidic communication with an outlet of the coolant channel and an inlet of the ventilation vessel, the inlet positioned vertically below an interface between liquid and vapor coolant in the ventilation vessel.

When the coolant in the thermosiphon coolant line is introduced into the ventilation vessel into the liquid coolant housed within the vessel, the temperature of the heated coolant is reduced. As a result, the likelihood of degradation of the housing of the ventilation vessel as well as other components in the ventilation vessel, such as a purge valve which may be positioned near the top of the vessel, is reduced. In this way, the thermosiphon system enables heat to be removed from the turbocharger bearing while at the same time reducing the likelihood of ventilation vessel degradation from heated coolant from the thermosiphon coolant line.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

Figure 1:
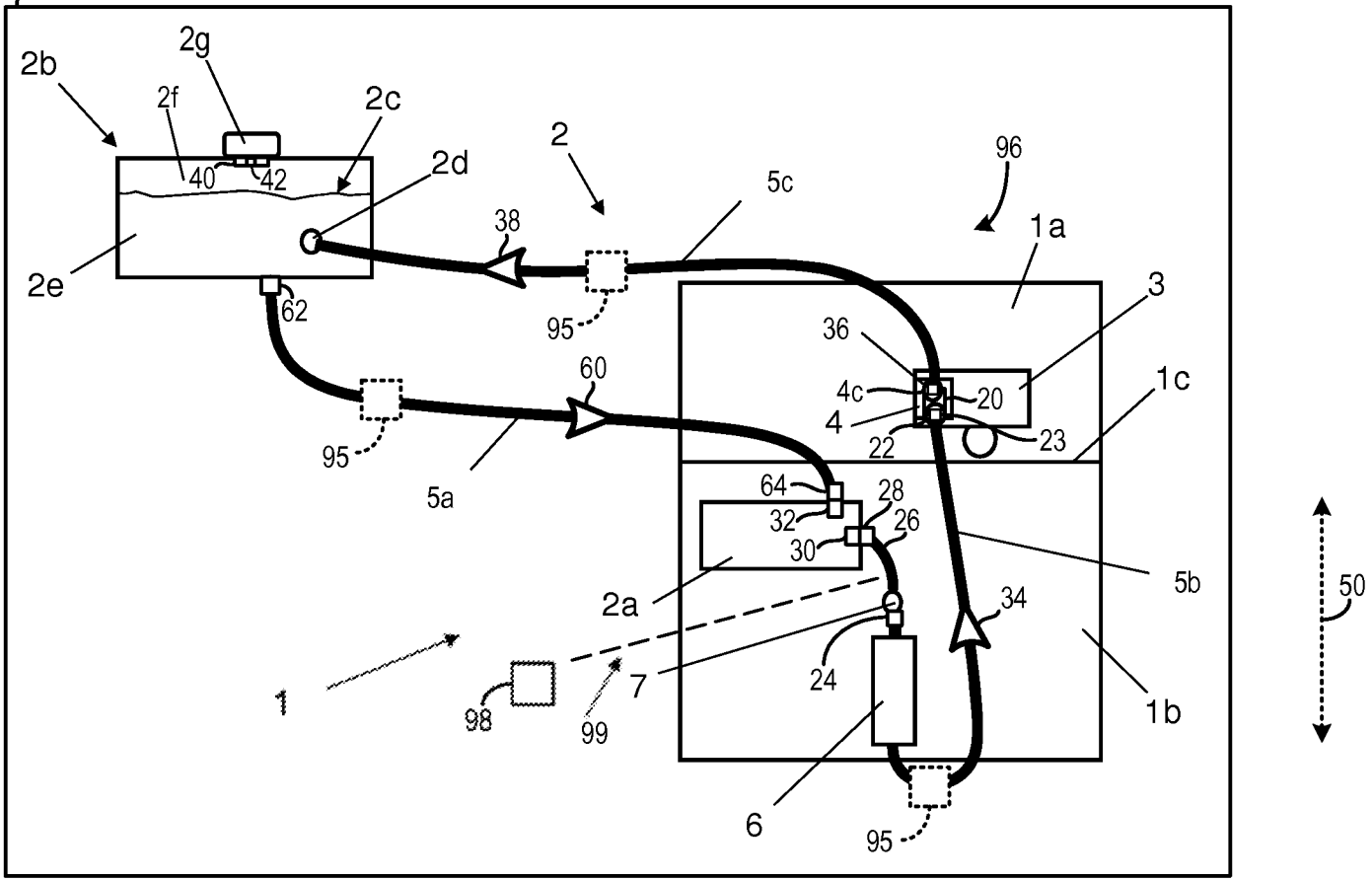
FIG. 1 schematically shows, in side view, a first embodiment of the boosted liquid-cooled internal combustion engine.

The figures are described in greater detail below.

DETAILED DESCRIPTION

A boosted liquid-cooled internal combustion engine is described herein. The engine may include at least one cylinder head which can be connected at an assembly end side to a cylinder block, wherein, in order to form a cooling circuit, a pump for conveying the coolant, a heat exchanger and a ventilation vessel are provided, and at least one exhaust-gas turbocharger, in which a compressor and a turbine are arranged on the same shaft which is rotatably mounted in a liquid-cooled bearing housing, wherein, in order to form the liquid-cooling arrangement, the bearing housing is connected into the cooling circuit of the internal combustion engine by a connecting coolant line and is arranged between the pump and the ventilation vessel, the connecting coolant line leads into the ventilation vessel, which, in addition to a volume of liquid coolant, also comprises a gas volume, at a point which is acted upon by liquid coolant. This arrangement enables the cooling of a bearing housing to be increased. In some examples, the connecting coolant line leads below the surface level of the liquid coolant into the ventilation vessel. In other words, the heated (e.g., superheated) and possibly gaseous coolant coming from the bearing housing is conveyed into the liquid coolant volume in the ventilation vessel with the use of the thermosiphon effect.

While introducing the heated (e.g., superheated) coolant above the coolant level may immediately thermally stress, possibly damage, the inner wall of the ventilation vessel, if the heated coolant is fed in below the surface level it mixes directly with the liquid coolant already in the vessel, wherein the mixing temperature which arises is significantly below the temperature of the heated coolant. Consequently, the thermal loading of the vessel is significantly reduced, thereby reducing the likelihood of thermal degradation of ventilation vessel. Thus, the cooling of the bearing housing may be increased while reducing thermal loading on the ventilation vessel.

Furthermore, the introduction of the heated coolant via the connecting coolant line into the liquid coolant in the ventilation vessel may also damp a pulsating conveying of the coolant, in which the coolant coming from the bearing housing is introduced into the ventilation vessel in surges. In this respect, a greatly pronounced frothing or enrichment of the coolant with air during the introduction of said coolant is reduced and in some cases avoided.

Not only is the vessel temperature reduced by the introduction of the coolant below the surface level. The vessel pressure is also reduced, and therefore the likelihood of inadvertent opening of a pressure control valve provided on the vessel is also reduced. The chance of an undesirable production of noise, for example a whistling, is reduced as a result.

Since the coolant liquid in the vessel is not a solid body but rather is movable, the position of the surface level depends on the installed position or current position of the vessel. In order to establish a fixed, unambiguous reference point, reference is made to a vehicle which is parked on even ground and has an internal combustion engine in the installed position, that is to say has the ventilation vessel in the installed position.

The engine may include two cylinders, each cylinder has at least one outlet opening for discharging the exhaust gases from the cylinder and an exhaust line is connected to each outlet opening, wherein the exhaust lines of at least two cylinders converge, with the formation of at least one integrated exhaust manifold, within the cylinder head to form at least one exhaust line which leads into the turbine of the at least one exhaust-gas turbocharger. In internal combustion engines having exhaust-gas turbocharging it may be desirable to arrange the at least one turbine close to the outlet of the cylinders. It is expedient here for the exhaust lines in the engine to converge within the cylinder head with at least one integrated exhaust manifold being formed. The length of the exhaust lines is thereby reduced. The line volume, that is to say the exhaust-gas volume of the exhaust lines upstream of the turbine, is reduced, and therefore the response behavior of the turbine is enhanced. The shortened exhaust lines also leads to a reduced thermal inertia of the exhaust system upstream of the turbine, and therefore the temperature of the exhaust gases at the turbine inlet is increased, as a result of which the enthalpy of the exhaust gases at the inlet of the turbine is also higher. Furthermore, the converging of the exhaust lines within the cylinder head permits dense packaging of the drive unit. Furthermore, the path of the hot exhaust gases to the different exhaust-gas aftertreatment systems is also shortened and the exhaust gases are given little time to cool down, as a result of which the exhaust-gas aftertreatment systems rapidly reach the operating temperature or light-off temperature thereof, in particular after a cold start of the internal combustion engine.

The engine may also include at least three cylinders divided into two groups (e.g., engines banks) having at least one cylinder, and the exhaust lines of the cylinders of each cylinder group each converge to form an exhaust line with an exhaust manifold being formed. This example, may be used in an engine having a twin-channel turbine. A twin-channel turbine may have an inlet region with two inlet ducts, wherein the two exhaust lines are connected to the twin-channel turbine in such a manner that in each case one exhaust line leads into one inlet duct. The two exhaust-gas streams conducted in the exhaust lines converge optionally downstream of the turbine. However, the grouping of the cylinders or exhaust lines also affords benefits for the use of a plurality of turbines or exhaust-gas turbochargers, wherein in each case one exhaust line is connected to one turbine.

Additionally, the internal combustion engine may include, in the installed position of the internal combustion engine, the inlet opening of the connecting coolant line into the ventilation vessel is at a greater vertical height than the outlet opening of the bearing housing, to which outlet opening the connecting coolant line is connected. A positive difference in height between the bearing housing and ventilation vessel, in which the inlet opening of the ventilation vessel is at a greater vertical height than the outlet opening of the bearing housing, assists the conveying of the coolant via the thermosiphon effect.

The engine may also include the connecting coolant line designed as a rising line. To utilize or improve the thermosiphon effect, it may be desirable for the connecting coolant line to be designed, at least upstream of the bearing housing, as a rising line in which the vertical height continuously increases.

However in other examples, the engine, in the installed position, may include the inlet opening of the connecting coolant line into the ventilation vessel positioned at a lower vertical height than the outlet opening of the bearing housing, to which outlet opening the connecting coolant line is connected. It will be appreciated that such an engine configuration may be used due to packaging constraints when a safety distance of the ventilation vessel from the engine hood may be desired.

The engine may also include a cooler is provided in the connecting coolant line between the pump and the bearing housing. The cooler reduces the coolant temperature before entry into the bearing housing and thus contributes to an increase in the residence time which may be needed to heat (e.g., superheat) the coolant in the bearing housing by the admission of heat.

When the engine is switched off (e.g., not in operation performing combustion) the bearing housing may be cooled for a period of time by other mechanisms, such a thermosiphon, to reduce the likelihood of thermal overheating. Further in some examples the cooler may be operated via air-cooling.

Additionally in some examples, cooling provided to the bearing may be designed as air cooling and/or liquid cooling. Since comparatively small quantities of heat have to be dissipated in the cooling of the bearing housing, it may be more cost effective to provide an air cooler upstream of the coolant channel in the bearing housing. However, other air cooler positions have been contemplated, such as downstream of the coolant channel in the bearing housing.

The use of an air cooler has additional benefits. For example, cooling systems may be provided with electrically operated fan motors (e.g., high performance electrically operated fan motors) which drive a fan wheel and are set into rotation to provide a desired air mass flow to the heat exchangers of the cooling system even when the motor vehicle is at a standstill, that is to say stationary, or at only low vehicle speeds. The fan wheel may be arranged in the vicinity of and at a distance from the heat exchanger in the front end region of the vehicle.

An air cooler provided upstream of the bearing housing may be arranged in the engine compartment in such a manner that the air flow guided through the fan flows around the air cooler and contributes to the transporting away of heat at the surface as a consequence of convection. This arrangement has several benefits in particular after the internal combustion engine is switched off when the fan is electrically operated further for a short period and the maintaining of the cooling is desired with regard to superheating of the coolant in the bearing housing. For the abovementioned reasons, embodiments of the internal combustion engine may be used in which the cooler is arranged between the cylinder block and the heat exchanger of the cooling circuit.

Additionally, the engine may include a throttle element configured to adjust the flow of coolant throughput (e.g., through the ventilation vessel). The throttle element may be positioned in a connecting coolant line between the pump and the ventilation vessel. The coolant throughput through the ventilation vessel may be reduced and in some cases minimized, in some examples.

Furthermore, the throttle element may be arranged downstream of the bearing housing in the connecting coolant line. However, in other examples the throttle element may be arranged upstream of the bearing housing in the connecting coolant line, since, upstream of the bearing housing, liquid coolant passes the throttle element and is throttled whereas, downstream of the bearing housing, heated and possibly vaporous coolant is present and throttling may have a detrimental effect on the conveying of the coolant utilizing the thermosiphon effect, in particular may promote pulsating conveying.

The engine may also include a valve, which may be self-controlled as a function of the coolant temperature. The valve may be arranged in the connecting coolant line between the pump and the ventilation vessel. The valve may also adjust the coolant throughput the ventilation vessel. The valve may be configured to reduce the conveying of coolant through the bearing housing at low coolant temperatures, in particular after a cold start of the internal combustion engine and during the warming-up phase, in some examples. Cooling or conveying of coolant at low coolant temperatures may not be desired in some examples, since this counters rapid heating of the internal combustion engine and of the assemblies thereof. Therefore in some examples, the coolant throughput through the ventilation vessel, in particular at low coolant temperatures, may be reduced. A certain residence period of the coolant in the ventilation vessel may be needed for ventilation, and therefore the throughput is reduced. Secondly, during low coolant temperature conditions the coolant's viscosity increased, thereby enriching the coolant with air.

The self-controlled valve, which may also be referred to as the thermostat valve, may vary or adjust the flow cross section of the connecting coolant line as a function of the coolant temperature and therefore controls the coolant throughput through the bearing housing in such a manner that the throughput is increased as the coolant temperature rises.

Consequently, the amount of coolant conveyed to the ventilation vessel is reduced as the temperature of the coolant is reduced via the valve. On the other hand, as the temperature of the coolant is increase so is the coolant flow to the ventilation vessel via the valve. This results in a supplying coolant to the bearing housing based on temperature and therefore the thermosiphon effect.

Additionally, the valve may be arranged upstream of the bearing housing in the connecting coolant line. Furthermore, the valve may be arranged downstream of the bearing housing in the connecting coolant line. The thermostat valve may be impinged on by coolant heated in the bearing housing. This may be beneficial since the valve can react with decreased delay to the temperature of the coolant in the bearing housing and therefore, in the control of the coolant throughput, is geared to the current thermal management in the bearing housing.

When the valve is positioned upstream of the bearing housing, a time delay may result due to the fact that the coolant situated in the connecting coolant line between the valve and the bearing housing has to be initially heated by heat conduction before the valve can react, by opening, to the temperatures present in the housing. Nevertheless, as already mentioned, the valve may be arranged upstream of the bearing housing in the connecting coolant line.

The valve may also be integrated into the bearing housing, which may enable a reduced delay reaction to the temperatures in the bearing housing. In addition, parts of the valve, for example the valve housing, may be jointly formed by the bearing housing and the cooling of the bearing housing may be used for cooling the valve. This yields further benefits, in particular a compact design and a saving on weight. The valve may also be integrated into the internal combustion engine, as a result of which the abovementioned benefits may be realized in an analogous manner.

The valve may be designed so as to be continuously adjustable or so as to be able to be switched in a two-stage fashion. A continuously adjustable valve permits a supply of coolant to the bearing housing according to demand in a wide range of operating states.

The valve may have a leakage flow in the closed position. Said leakage flow may prevent total closure of the connecting coolant line at low temperatures, as a result of which the conveying of coolant cannot be completely prevented. Nevertheless, a certain degree of leakage of the valve, that is to say lack of tightness, may be beneficial in order to permit the thermo-element, which may be arranged in the valve and which may initiate the opening process, is impinged on by coolant.

The connecting coolant line may also lead through the cylinder block. In the installed position, the cylinder block may be arranged low in the engine compartment. That is to say at a vertical height which is lower than the turbine. If the connecting coolant line then leads through the cylinder block upstream of the turbine, this may be beneficial in particular with regard to the utilization of the thermosiphon effect and the formation of the connecting coolant line as a rising line. In this configuration, the turbine and the bearing housing to be cooled are arranged vertically higher than the cylinder block.

However, embodiments of the internal combustion engine may also be used in which the connecting coolant line leads through the cylinder head. In the case of internal combustion engines in which the turbine is arranged above the cylinder block, on that side of the assembly end side which faces toward the cylinder head, the connecting coolant line may also lead from the cylinder head to the bearing housing of the turbine without the need to dispense with the design of the line as a rising line.

The at least one turbine may be designed as a radial turbine, that is to say the flow approaching the rotor blades runs substantially radially. Here, "substantially radially" means that the speed component in the radial direction is greater than the axial speed component. The speed vector of the flow intercepts the shaft or axle of the turbine (e.g., at right angles), if the approaching flow runs radially. In order to enable the rotor blades to be approached by flow radially, the inlet region for the supply of the exhaust gas may be designed as an encircling spiral or worm housing such that the inflow of exhaust gas to the turbine runs substantially radially. However, the at least one turbine may also be designed as an axial turbine in which the speed component in the axial direction is greater than the speed component in the radial direction.

Additionally, the at least one turbine may be equipped with a variable turbine geometry, which enables more precise adaptation to the respective operating point of an internal combustion engine by means of adjustment of the turbine geometry or of the effective turbine cross section. In this case, adjustable guide blades for influencing the flow direction may be arranged in the inlet region of the turbine. In contrast, to the rotor blades of the rotating rotor, the guide blades may not rotate with the shaft of the turbine.

If the turbine has a fixed, invariable geometry, the guide blades may be arranged in the inlet region so as to be not only stationary but also completely immovable, that is to say rigidly fixed. In contrast, in the case of a variable geometry, the guide blades may be arranged so as to be stationary but not so as to be completely immovable but rather so as to be rotatable about the axis thereof such that the flow approaching the rotor blades can be adjusted. Additionally, the engine may include a plurality of turbochargers, the turbines and compressors of which are arranged in series or parallel.

FIG. 1 shows schematically, in side view, a first embodiment of the boosted liquid-cooled internal combustion engine 1. The term "internal combustion engine" encompasses compression ignition engines (e.g., diesel engines), spark-ignition engines, and also hybrid internal combustion engines. A vertical axis 50 is provided for reference. The vertical axis 50 may be parallel to a gravitational axis. The engine 1 may be included in a vehicle 70. In the depicted embodiment the vehicle 70 may be positioned on even ground in the depicted embodiment. However, other relative vehicle and engine orientations have been contemplated.

The internal combustion engine 1 may comprise a cylinder head 1*a* which is connected on a side 1*c* (e.g., assembly end side, top side) to a cylinder block 1*b*. Thus, the cylinder head 1*a* and the cylinder block 1*b* are coupled together.

The engine cooling circuit 2 includes a pump 2*a*. The pump is configured to convey or flow coolant through a cooling circuit 2. The pump 2*a* is connected via a connecting coolant line 5*a* to a ventilation vessel 2*b*. The coolant line 5*a* includes an inlet 62 and an outlet 64. The inlet 62 opens into the ventilation vessel 2*b*. Thus, the inlet is in fluidic communication with the ventilation vessel 2*b*. The inlet 62 may be positioned vertically below the outlet of the connecting coolant line 5*c* in some examples. However, other relative positions have been contemplated. The outlet 64 is in fluidic communication (e.g., direct fluidic communication) with an inlet 32 of the pump 2*a*, described in greater detail herein. The ventilation vessel 2*b* may comprise plastic and/or metal in some examples. Arrow 60 denotes the general flow of coolant through the connecting coolant line 5*a*. However, it will be appreciated that the coolant flow may have additional complexity. Degassed coolant is supplied to the cooling circuit 2 via connecting coolant line 5*a* positioned downstream of pump 2*a*.

The internal combustion engine 1 is boosted by an exhaust-gas turbocharger 3 which comprises a compressor and a turbine which are arranged on a common shaft. The shaft is mounted rotatably in a liquid-cooled bearing housing 4.

A coolant channel 20 traverses the bearing housing 4 and may be included in the engine cooling circuit 2. An inlet 22 of the coolant channel 20 is in fluidic communication (e.g., direct fluidic communication) with an outlet 23 of the connecting coolant line 5*b*. The coolant channel 20 also includes an outlet 4*c*. Direct fluidic communication means that there are not intermediary component positioned between the components that are in fluidic communication. An inlet 24 of the connecting coolant line 5*b* is in fluidic communication (e.g., direct fluidic communication) with an outlet 7 also referred to as a removal point, of one or more coolant passages 26. The one or more coolant passages 26 are shown traversing the cylinder block 1*b*. However, it will be appreciated that the one or more cylinder passage may alternatively or additionally traverse the cylinder head 1*a*. The one or more cylinder passages 26 include one or more inlets 28 in fluidic communication (e.g., direct fluidic communication) with an outlet 30 of the pump 2*a*. It will be appreciated that additional coolant passages may be in fluidic communication with the outlet 30 of the pump 2*a*. The additional coolant passages may also be in fluidic communication with an inlet 32 of the pump 2*a*. In this way, coolant may be circulated through the cylinder block and/or the cylinder head. It will be appreciated that the inlet of the connecting coolant line 5*b* may be positioned vertically below the inlet 22. However, other relative positions have been contemplated.

A cooler 6 (e.g., air cooler, tubular air cooler, etc.,) may be coupled to the coolant line 5*b*. The cooler 6 may be configured to remove heat from the coolant before it flows through the coolant channel 20. Thus, the air cooler is positioned upstream of the coolant channel 20. The air cooler may flow air around coolant channels to remove the heat from the coolant. In some examples, a fan may be used to circulate air around the air cooler. However, in other examples the vehicle motion may be used to circulate air around the air cooler. Arrow 34 denotes the general flow of coolant through the coolant line 5*b*.

The engine 1 further includes the connecting coolant line 5*c*. It will be appreciated that the connecting coolant lines (5*a*, 5*b*, and/or 5*c*) may be referred to as a first connecting coolant line, a second connecting coolant line, and/or a third connecting coolant line, depending on the introductory order. Furthermore, the connecting coolant lines may be thermosiphon coolant lines in some embodiments. Additionally, the connecting coolant lines (5*a*, 5*b*, and 5*c*) may be external to the cylinder block 1*b* and the cylinder head 1*a*. The connecting coolant line 5*c* includes an inlet 36 in fluidic communication (e.g., direct fluidic communication) with the outlet 4*a* of the coolant channel 20. The connecting coolant line 5*c* also includes an outlet 2*d* opening into the ventilation vessel 2*b*. As shown, the outlet 2*d* is positioned below the liquid coolant level 2*c*. Thus, the outlet 2*d* is positioned within the liquid coolant. In some examples, the connecting coolant line may extend into the liquid coolant in the ventilation vessel to increase cooling of the connecting coolant line. As shown, the ventilation vessel 2*b* housing a volume of liquid coolant 2*e* and a volume of gaseous coolant 2*f*. Therefore, the liquid coolant level 2*c* is at the interface of the liquid and gaseous coolant volumes.

The outlet 2*d* of the connecting coolant line 5*c* is positioned at a greater vertical height than the inlet 36 of the connecting coolant line 5*c* in the depicted example. Thus, the outlet 4*c* of the coolant channel 20 is positioned below the outlet 2*d* of the connecting coolant line 5*c*. However, in other examples, the outlet 2*d* may be positioned below an inlet of connecting coolant line 5*c* in fluidic communication with the outlet 4*a* of the coolant channel 20.

The positive difference in vertical height between the bearing housing 4 and specifically the coolant channel 20 traversing the bearing housing and the ventilation vessel 2*b* assists the thermosiphon effect. The thermosiphon effect may even be achieved in the depicted embodiment when the connecting coolant line 5*c* does not continuously increase in vertical height along its length in a downstream direction. Arrow 38 indicates the general flow of coolant through the connecting coolant line 5*c*. However, in some examples, the connecting coolant line 5*c* may continuously increase in vertical height along its length in a downstream direction.

As previously discussed, the connecting coolant line 5*c* leads into the ventilation vessel 2*b* below the coolant level 2*c*. Heated (e.g., superheated) and possibly gaseous coolant coming from the coolant channel 20 in the bearing housing 4 is thereby conveyed into the volume of liquid coolant 2*e* in the ventilation vessel 2*b*. The feeding in of the heated coolant below the liquid level 2*c* results in direct mixing with the liquid coolant already in the vessel 2*b*, thus significantly reducing the thermal loading of the vessel 2*b*.

Additionally, the vessel 2*b* is provided with a cover 2*g* which closes a vessel opening 40, which serves for filling the vessel 2*b* with coolant, and also accommodates a pressure control valve 42.

The internal combustion engine 1 may also include a flow adjusting element 95. The flow adjusting element may be positioned in one of the connecting coolant lines (5*a*, 5*b*, and 5*c*). It will be appreciated that additional flow adjusting elements may be positioned in the connecting coolant lines (5*a*, 5*b*, and 5*c*). The flow adjusting element may be a throttle element configured to adjust coolant flow in the connecting coolant line. The throttle element may be controlled via a controller in some examples. However, in other examples the flow adjusting element 95 may be a self controlled valve element (e.g., a thermostat element). The flow adjusting element may be configured to alter the coolant flow in the connecting coolant line. Specifically, in one embodiment, the flow adjusting element may be configured to decrease coolant flow in response to a decrease in coolant temperature and increase coolant flow in response to an increase in coolant temperature. However, other control methods have been contemplated.

The connecting coolant lines (5*a*, 5*b*, and 5*c*), the coolant channel 20, the ventilation vessel 2*b*, the cooler 6, the pump 2*a* and/or valve 95 may be included in a thermosiphon system 96. The cooling circuit 2 may also include a heat exchanger 98. The heat exchanger 98 may be coupled to a coolant passage traversing at least one of the cylinder block 1*c* or cylinder head 1*a*, indicated by line 99. In some embodiments, the heat exchanger 98 may be coupled to one of the coolant passages 26.

Figure 2:
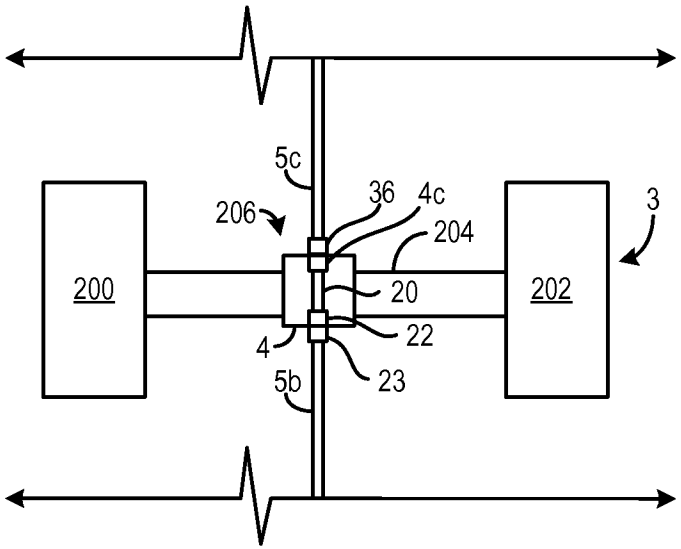
FIG. 2 shows a second embodiment of the boosted liquid-cooled internal combustion engine.

FIG. 2 shows a detailed view of an example exhaust-gas turbocharger 3 included in the engine 1, shown in FIG. 1. The turbocharger 3 includes a compressor 200 mechanically coupled to a turbine 202 via a shaft 204. The compressor 200 is in fluidic communication with at least one combustion chamber in the engine 1, shown in FIG. 1. Furthermore, an intake throttle may be positioned downstream of the compressor 200, in some embodiments. Specifically, the compressor 200 is configured to delivery compressed intake air to the combustion chamber. The turbine 202 is also in fluidic communication with the combustion chamber. Specifically, the turbine 202 is configured to receive exhaust gases from the combustion chamber. It will be appreciated that one or more emission control devices may be positioned upstream and/or downstream of the turbine. In this way, the turbocharger 3 uses exhaust gas to drive the turbine. In turn, the turbine rotates the shaft which drives the compressor.

A bearing 206 may be mechanically coupled to the shaft 204. The bearing 206 may support the shaft 204 as well as enable rotation of the shaft. The bearing housing 4 included in the bearing is also depicted. The coolant channel 20 is shown traversing the bearing housing 4. The inlet 22 and outlet 4*c* of the coolant channel 20 are also shown. The connecting coolant line 5*c* and the inlet 36 of the connecting coolant line 5*c* are also shown. Additionally, the connecting coolant line 5*b* and its outlet 23 are also shown in FIG. 2.

It will be appreciated that the configurations and routines disclosed herein are exemplary in nature, and that these specific embodiments are not to be considered in a limiting sense, because numerous variations are possible. For example, the above technology can be applied to other types inline engines, opposed engines, V type engines, etc. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine thermosiphon system comprising:

a coolant channel traversing a bearing housing in a bearing coupled to a turbocharger turbine shaft;

a ventilation vessel in fluidic communication with a cooling circuit coolant passage traversing an engine cylinder head; and a first section of thermosiphon coolant line having an inlet in fluidic communication with a coolant channel outlet and an inlet of the vessel positioned vertically below an interface between liquid and vapor coolant in the vessel; and a cooler positioned in a second section of thermosiphon coolant line positioned between a pump in fluidic communication with the cooling circuit coolant passage and an inlet of the coolant channel traversing the bearing housing.

2. A thermosiphon system in an engine comprising:

a coolant channel traversing a bearing housing, the bearing housing included in a bearing coupled to a shaft mechanically coupled to a turbine and a compressor in a turbocharger;

a ventilation vessel in fluidic communication with at least one coolant passage traversing at least one of a cylinder head and a cylinder block in the engine, the at least one coolant passage included in a cooling circuit;

a first section of thermosiphon coolant line having an inlet in fluidic communication with an outlet of the coolant channel and an inlet of the ventilation vessel, the inlet positioned vertically below an interface between liquid and vapor coolant in the ventilation vessel; and a cooler positioned in a second section of thermosiphon coolant line positioned between a pump in fluidic communication with the at least one coolant passage and an inlet of the coolant channel traversing the bearing housing.

3. The thermosiphon system of claim 2, where the first section of thermosiphon coolant line continuously increases in vertical height along a downstream direction.

4. The thermosiphon system of claim 2, further comprising a third section of thermosiphon coolant line including an inlet of the third section of thermosiphon coolant line in fluidic communication with the ventilation vessel and an inlet of the pump included in the cooling circuit.

5. The thermosiphon system of claim 4, where an outlet of the pump is in fluidic communication with the at least one coolant passage.

6. The thermosiphon system of claim 4, further comprising a flow adjustment valve positioned in the third section of thermosiphon coolant line, the flow adjustment valve adjusting a flow of coolant in the third section of thermosiphon coolant line.

7. A boosted liquid-cooled internal combustion engine comprising:

a cylinder head coupled to a side of a cylinder block;

a cooling circuit including a pump in fluidic communication with one or more coolant passages traversing at least one of the cylinder head and cylinder block, a heat exchanger in fluidic communication with the pump, and a ventilation vessel in fluidic communication with the pump, the ventilation vessel housing a volume of liquid coolant and a gas volume of coolant and in fluidic communication with the pump;

an exhaust-gas turbocharger including a compressor coupled to a turbine via a shaft rotatably mounted in a liquid-cooled bearing housing including a coolant channel traversing the liquid-cooled bearing housing, the coolant channel in fluidic communication with a first section of connecting coolant line having an outlet opening in the ventilation vessel within the volume of liquid coolant; and a cooler positioned in a second section of connecting coolant line positioned between the pump and an inlet of the coolant channel traversing the liquid-cooled bearing housing.

8. The boosted liquid-cooled internal combustion engine of claim 7, where the outlet of the first section of connecting coolant line is at a greater vertical height than an outlet of the coolant channel in direct fluidic communication with an inlet of the first section of connecting coolant line.

9. The boosted liquid-cooled internal combustion engine of claim 7, where the first section of connecting coolant line continuously increases in vertical height in a downstream direction.

10. The boosted liquid-cooled internal combustion engine of claim 7, where the outlet of the first section of connecting coolant line is at a lower vertical height than an outlet of the coolant channel in direct fluidic communication with an inlet of the first section of connecting coolant line.

11. The boosted liquid-cooled internal combustion engine of claim 7, where the cooler is an air cooler.

12. The boosted liquid-cooled internal combustion engine of claim 7, wherein the cooler is arranged between the cylinder block and the heat exchanger of the cooling circuit.

13. The boosted liquid-cooled internal combustion engine of claim 7, further comprising a throttle element positioned in a third section of connecting coolant line including an inlet opening into the ventilation vessel and an outlet in direct fluidic communication with an inlet of the pump, the throttle element adjusting coolant flow in the third section of connecting coolant line.

14. The boosted liquid-cooled internal combustion engine of claim 7, further comprising a throttle element positioned in the first section of connecting coolant line, the throttle element adjusting coolant flow in the first section of connecting coolant line.

15. The boosted liquid-cooled internal combustion engine of claim 7, further comprising a throttle element positioned in the second section of connecting coolant line positioned between the pump and the inlet of the coolant channel traversing the liquid-cooled bearing housing, the throttle element adjusting coolant flow in the second section of connecting coolant line.

16. The boosted liquid-cooled internal combustion engine of claim 7, further comprising a self-controlled valve element positioned in a third section of connecting coolant line including an inlet opening into the ventilation vessel and an outlet in direct fluidic communication with an inlet of the pump, the self-controlled valve configured to adjust the flow of the coolant through the ventilation vessel.

17. The boosted liquid-cooled internal combustion engine of claim 7, further comprising a self-controlled valve element positioned in the second section of connecting coolant line positioned between an inlet of the coolant channel and an outlet of one or more of the coolant passages.

18. The boosted liquid-cooled internal combustion engine of claim 7, further comprising a self-controlled valve element positioned in the first section of connecting coolant line.

19. The boosted liquid-cooled internal combustion engine of claim 7, wherein the second section of connecting coolant line is positioned between an inlet of the coolant channel and an outlet of one or more of the coolant passages, the one or more coolant passages traversing the cylinder block.

* * * * *